US006578494B1

(12) United States Patent
Cummins

(10) Patent No.: US 6,578,494 B1
(45) Date of Patent: Jun. 17, 2003

(54) PROPULSION/BRAKING APPARATUS FOR A GUIDED VEHICLE

(76) Inventor: Richard D. Cummins, 33 Harmony Cir., Orchard Park, NY (US) 14127

( * ) Notice: Subject to any disclaimer, the term of this patent is extended or adjusted under 35 U.S.C. 154(b) by 0 days.

(21) Appl. No.: 10/056,581

(22) Filed: Jan. 25, 2002

(51) Int. Cl.[7] ..... B61B 13/00
(52) U.S. Cl. ..... 104/155
(58) Field of Search ..... 104/155, 134, 104/23.1, 23.2; 251/28, 25, 61.1

(56) References Cited

U.S. PATENT DOCUMENTS 3,467,024 A * 9/1969 Broniewski et al. ..... 104/134
3,586,382 A * 6/1971 Pitkanen ..... 104/155
3,595,173 A * 7/1971 Giraud ..... 104/23.2
3,685,788 A * 8/1972 Bloomfield ..... 251/28
3,718,096 A * 2/1973 Bloomfield et al. ..... 104/155
3,808,977 A * 5/1974 Smoot et al. ..... 104/23.2
3,815,866 A * 6/1974 Wirth ..... 251/25
3,889,602 A * 6/1975 Barber ..... 104/23.2
4,085,681 A * 4/1978 Barber ..... 104/23.2
4,175,637 A * 11/1979 Bertelsen ..... 104/23.2
4,969,401 A * 11/1990 Kolm ..... 104/284
6,076,469 A * 6/2000 Coester ..... 104/155
6,178,892 B1 * 1/2001 Harding ..... 104/155
6,389,983 B1 * 5/2002 Coester et al. ..... 104/155

* cited by examiner

*Primary Examiner*—S. Joseph Morano
*Assistant Examiner*—Lars A. Olson
(74) *Attorney, Agent, or Firm*—Simpson & Simpson, PLLC

(57) ABSTRACT

The present invention comprises an apparatus for propelling and braking a vehicle traveling along a guideway. The apparatus comprises a plurality of nozzles located along the length of the guideway that direct fluid jets. Strip valves are arranged end-to-end along the guideway. Each of the strip valves controls the fluid flow from a group of the nozzles. A power unit is mounted for travel along the guideway. The power unit opens the strip valves in succession to release fluid jets from the nozzles controlled by the strip values. Thrust vanes on the power unit are arranged to receive impulse energy from the released fluid jets to propel the power unit along either direction of the guideway. The vehicle is connected to the power unit.

26 Claims, 10 Drawing Sheets

PROPULSION/BRAKING APPARATUS FOR A GUIDED VEHICLE

BACKGROUND OF THE INVENTION

The present invention relates generally to vehicle propulsion apparatuses. More particularly, the present invention relates to an apparatus to propel a vehicle along a track.

There is a current need for an efficient means of transportation between urban centers. One of the proposed solutions is to use railed vehicles. However, these solutions often involve propulsion systems that add a great deal of weight to the vehicle, such as electromagnetic propulsion. The result of this added weight is that the structure needed to support the track is greater, requiring larger right of ways for the track and extensive earthworks. Current rail travel often uses diesel engines, contributing to air pollution. The diesel trains are loud as well, reducing the area where track can be routed. In addition, the turning radius of most existing and proposed rail vehicles is very large, further constraining the configurations of track that can be used.

One proposed solution to the above problems is to use jets of fluid impinging on the vehicle to impart momentum to the railed vehicle. The problem with this solution is that the fluid jets and the vanes on the vehicle to receive the jets must be kept in close proximity. This is very difficult to achieve due to the normal dipping and swaying of a railed vehicle. Thus, there is a need for a railed vehicle that can maintain the close tolerances needed to allow it to be propelled with fluid jets.

BRIEF SUMMARY OF THE INVENTION

Therefore, it is an object of the present invention to provide a railed vehicle that can be propelled by fluid jets impinging on it.

It is another object of the present invention to minimize noise and pollution.

It is yet another object of the present invention to minimize the weight of the vehicles to minimize the support structures required.

It is yet another object of the present invention to operate at speeds up to 300 miles per hour.

In furtherance of these and other objects, the present invention comprises an apparatus for propelling and braking a vehicle traveling along a guideway. The apparatus comprises a plurality of nozzles located along the length of the guideway that direct fluid jets. Strip valves are arranged end-to-end along the guideway. Each of the strip valves controls the fluid flow from a group of the nozzles. A power unit is mounted for travel along the guideway. The power unit opens the strip valves in succession to release fluid jets from the nozzles controlled by the strip values. Thrust vanes on the power unit are arranged to receive impulse energy from the released fluid jets to propel the power unit along either direction of the guideway. The vehicle is connected to the power unit with longitudinal tension rods, which transmit the jet impulse to the vehicle. This allows relatively large lateral motions of the vehicle.

BRIEF DESCRIPTION OF THE SEVERAL VIEWS OF THE DRAWINGS

The nature and mode of operation of the present invention will now be more fully described in the following detailed description of the invention taken with the accompanying drawing figures, in which.

DETAILED DESCRIPTION OF THE INVENTION

It should be appreciated that in the detailed description of the invention which follows that like reference numbers on different drawing views are intended to identify identical structural elements of the invention in the respective views.

Figure 1:
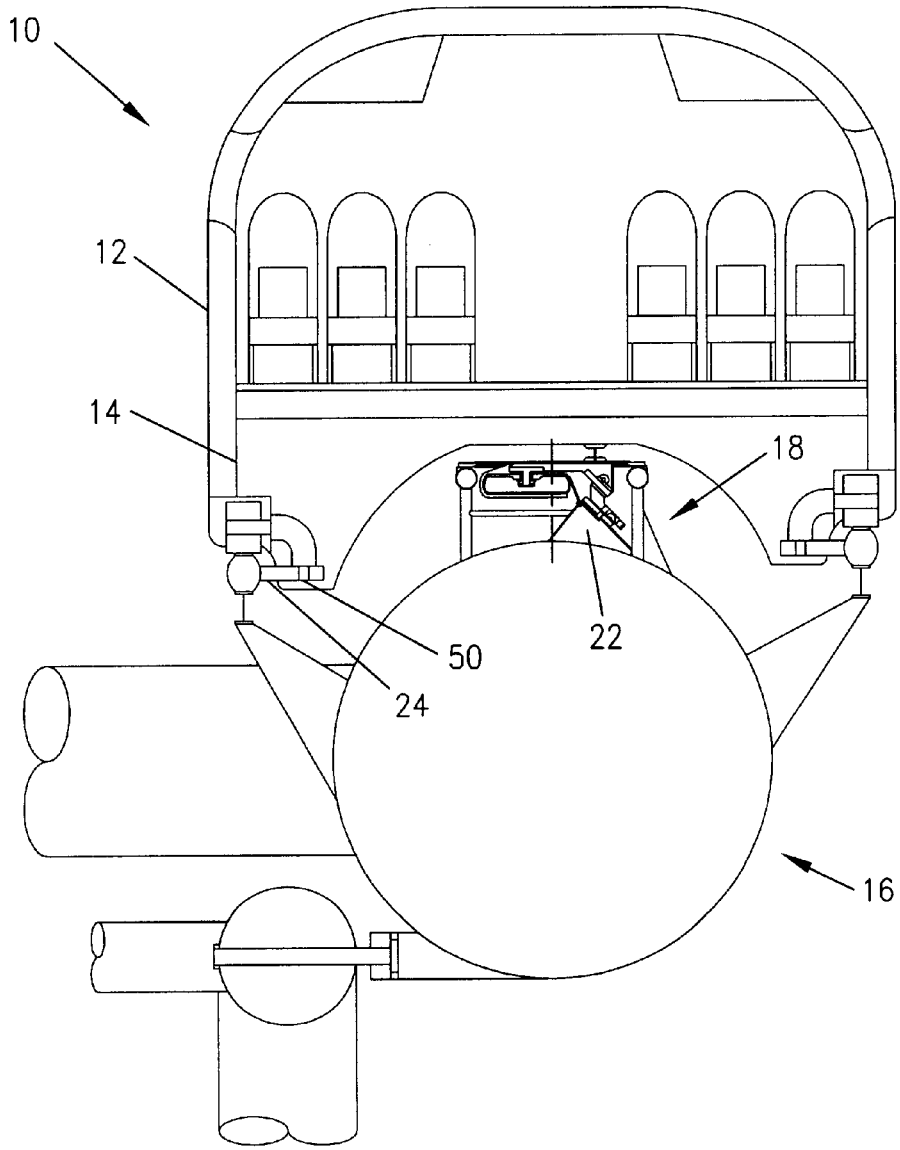
FIG. 1 is a front view of the power unit, vehicle, and track of the present invention.

A front cutaway view of the present invention is shown in FIG. 1 and designated 10. It comprises vehicle 12 that is connected to power unit 14. Power unit 14 has power unit guide wheels 50 that receive guide wheel tracks 24. Guide wheel tracks 24 keep the power unit on track 16. The vehicle is propelled by the release of fluid from fluid plenum 22. Propulsion assembly 18, shown in greater detail in its various embodiments in the succeeding figures, releases the fluid to propel the vehicle. FIG. 1 shows an embodiment of the present invention with the vehicle above the track. Other embodiments described herein position the vehicle below the track. Both configurations are within the spirit and scope of the invention as claimed.

Figure 2:
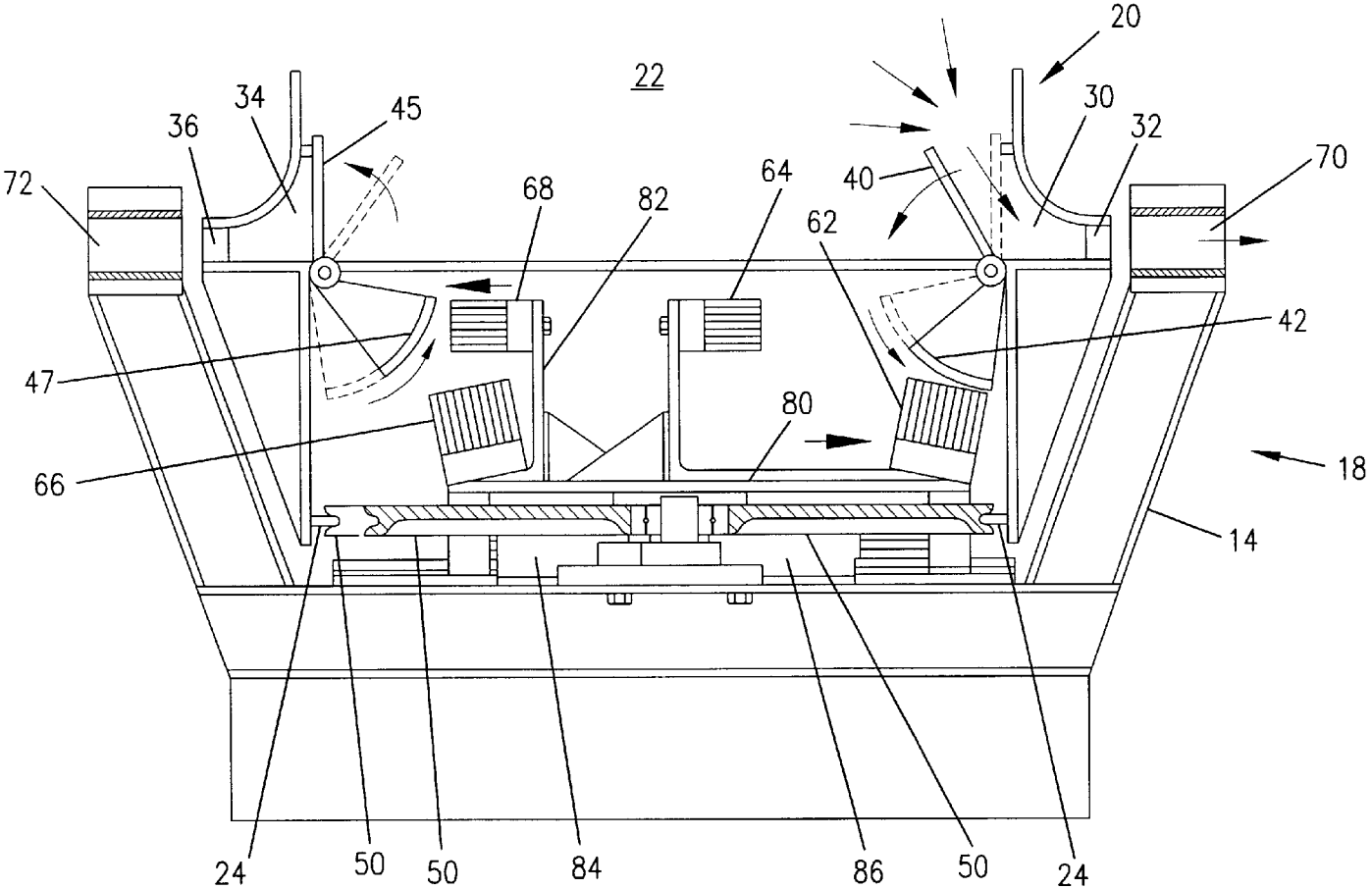
FIG. 2 is a front view of the first embodiment of the propulsion assembly.

A front view of the first embodiment of the propulsion assembly is shown in FIG. 2 and designated 18. Upper structure 20 is connected to the track and runs the length of the track. Power unit 14 is connected to the vehicle and runs only the length of the vehicle. Upper structure 20 comprises fluid plenum 22, guide wheel tracks 24, pluralities of nozzles 30 and 34, pluralities of nozzle vanes 32 and 36, and strip valves 40 and 45. Strip valves 40 and 45 run end-to-end along both sides of the upper structure, to control the flow of fluid to pluralities of nozzles 30 and 34. Fluid plenum 22 contains fluid under pressure. In the preferred embodiment, this fluid is air at approximately 30 psi. Forward facing nozzles 30 receive fluid from plenum 22 when strip valve 40 is opened. The fluid travels forward through nozzles 30, nozzle vanes 32, and on through forward thrust vanes 70. This provides forward thrust to the power unit and vehicle. Strip valve 40 is opened when power unit magnet 62 attracts strip valve armature 42. When armature 42 is attracted by power unit magnet 64, armature 42 moves to close strip valve 40.

The vehicle is decelerated when fluid passes from the plenum through rearward facing nozzles 34, nozzle vanes 36, and on through thrust reversing vanes 72. This occurs when strip valve 45 is opened. Strip valve 45 is opened when power unit magnet 66 attracts strip valve armature 47. Strip valve 45 is closed when power unit magnet 68 attracts strip valve armature 47. Magnets 62 and 66 are mounted on bracket 80 and magnets 64 and 68 are mounted on bracket 82. Actuator 84 moves bracket 80. Actuator 86 moves bracket 82. Thus, to open valve 40 and close valve 45, bracket 80 is moved towards valve 40 and bracket 82 is moved towards valve 45. To open valve 45 and close valve 40, bracket 80 is moved towards valve 45 and bracket 82 is moved towards valve 40. To close both valves, both brackets are centered. Any actuator known in the art may be used, including, but not limited to, electric motors, hydraulic pistons, and pneumatic pistons.

Figure 3:
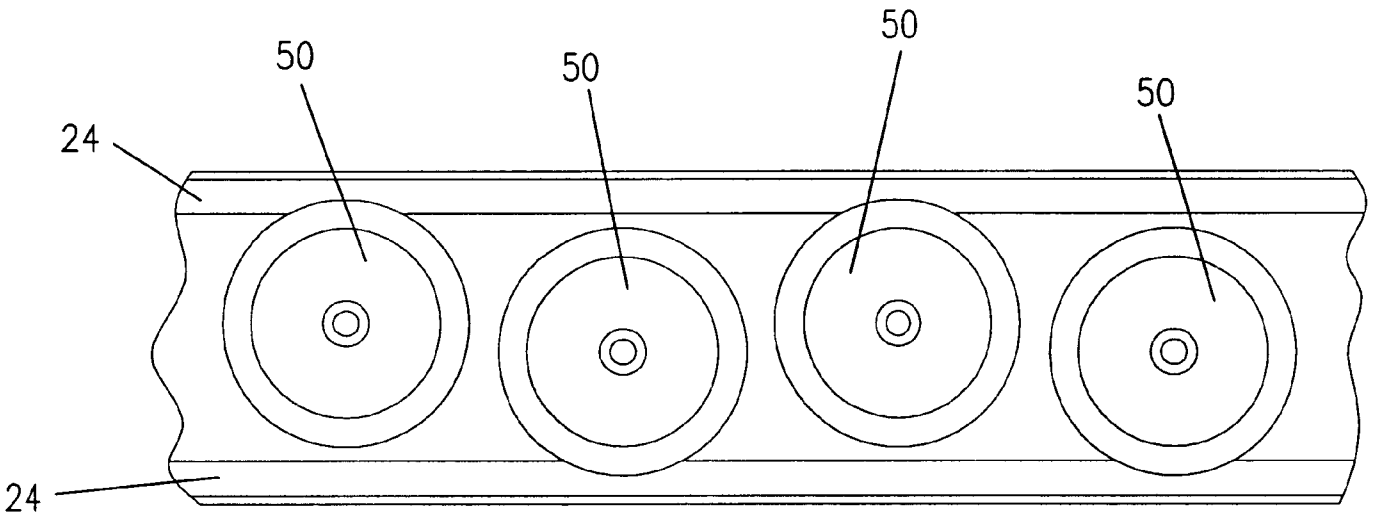
FIG. 3 is a top view of the power unit guide wheels.

FIG. 2 also shows that power unit guide wheels 50 do not extend from the left guide wheel track to the right one. Each power unit guide wheel engages only one guide wheel track, every other wheel engaging the same side. The alternating placement of the power unit guide wheels is shown in a top view of the power unit guide wheels in FIG. 3.

Figure 4:
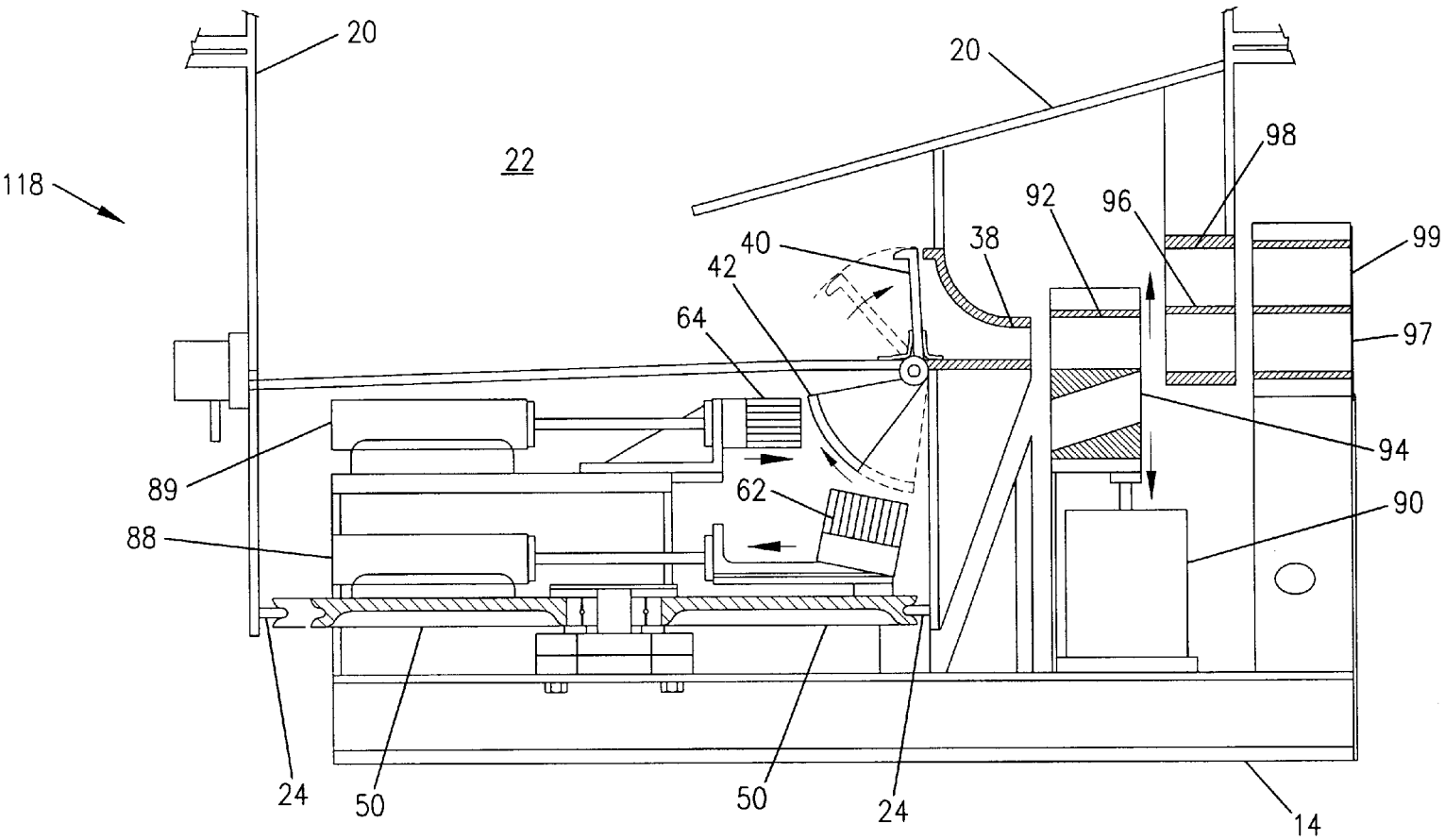
FIG. 4 is a front view of the second embodiment of the propulsion assembly.

A front view of the second embodiment of the propulsion assembly is shown in FIG. 4 and designated 118. Upper structure 20 is connected to the track and runs the length of the track. Power unit 14 is connected to the vehicle and runs only the length of the vehicle. Upper structure 20 comprises fluid plenum 22, guide wheel tracks 24, plurality of nozzles 38, plurality of strip valves 40, forward jet vanes 96, and reverse jet vanes 98. Each power unit guide wheel 50 engages one guide wheel track 24, alternating sides as in FIG. 3. Fluid plenum 22 contains fluid under pressure. Transverse facing nozzles 38 receive fluid from plenum 22 when strip valve 40 is opened. Strip valve 40 is opened when power unit magnet 62 attracts strip valve armature 42. When armature 42 is attracted by power unit magnet 64, armature 42 moves to close strip valve 40. Magnet 62 is moved toward and away from armature 42 by actuator 88. Magnet 64 is moved toward and away from armature 42 by actuator 89.

When strip valve 40 is open, fluid travels perpendicular to the track direction through nozzles 38. The fluid then travels through either forward jet passage 92 or reverse jet passage 94. Actuator 90 moves to position either forward passage 92 or reverse passage 94 in the path of the fluid flow. If forward passage 92 is in the path of the fluid flow, then the fluid will travel on through forward jet vanes 96 and forward thrust vanes 97. This will accelerate the vehicle. Otherwise the fluid will flow through reverse jet vanes 98 and reverse thrust vanes 99. This will decelerate the vehicle. Thrust vanes 97 and 99, actuator 90, and passages 92 and 94 are connected to power unit 14 and thus move with the vehicle. Jet vanes 96 and 98 are connected to upper structure 20 and are thus stationary.

Figure 5:
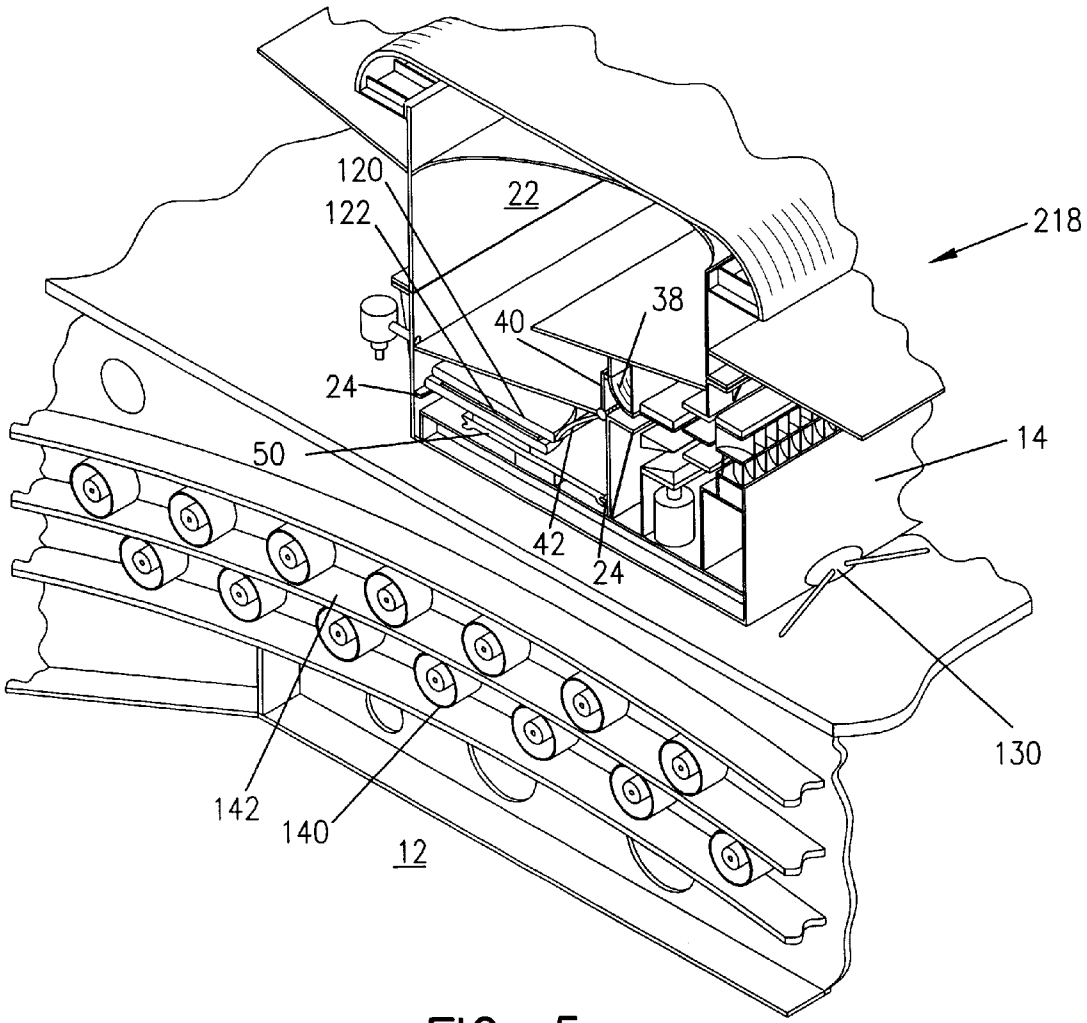
FIG. 5 is a front view of the third embodiment of the propulsion assembly.

FIG. 5 shows a perspective view of the front of the third embodiment of the propulsion assembly, designated 218. Similar to the second embodiment, each power unit guide wheel 50 engages one guide wheel track 24, alternating sides as in FIG. 3 Also similar, nozzles 38 are on one side of the power unit and are perpendicular to the track direction. The configuration of thrust vanes and jet vanes is the same as shown in FIG. 4. However, strip valve armature 42 is opened differently in this embodiment. Here, valve 40 is opened when wheel 120 is moved by actuator 122 to depress armature 42. To close valve 40, actuator 122 moves wheel 120 away from armature 42, and the pressure in plenum 22 closes valve 40. Tension rods 130 are also shown in FIG. 5. These rods transfer the thrust from power unit 14 to vehicle 12. Rods 130 only carry axial forces, allowing vehicle 12 to move with respect to power unit 14. Rollers 140 are positioned against roller strip 142 to allow vehicle 12 to rotate around an axis parallel to the track.

Figure 6:
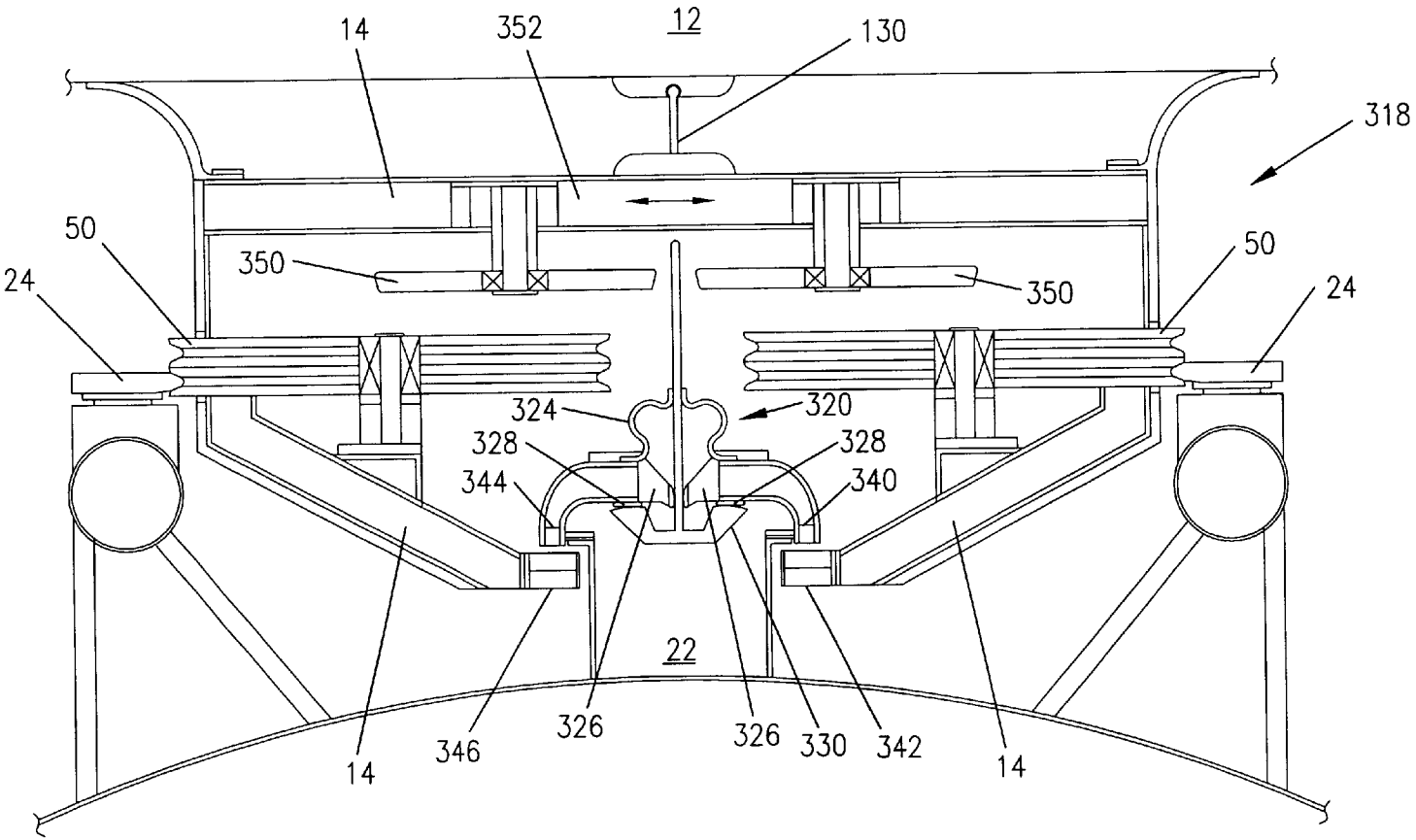
FIG. 6 is a front view of the fourth embodiment of the propulsion assembly.

A fourth embodiment of the propulsion assembly is shown in FIG. 6 and designated 318. In this embodiment, fluid from plenum 22 travels through two-way strip valve 320. Valve 320 comprises valve stem 322, valve boot 324, valve fulcrums 326, valve seats 328, and valve head 330. Wheels 350 are moved by actuator 352 against one side of stem 322 or the other to open the valve. If wheels 350 are moved to the right, such that the left wheel contacts the left side of stem 322, then flexible boot 324 will allow the stem to pivot around right fulcrum 326, moving head 330 to the left. Head 330 will disengage from right valve seat 328. Fluid from plenum 22 will then travel through forward nozzle vanes 340 and forward propulsion vanes 342. This will accelerate the vehicle. If wheels 350 are moved to the left, such that the right wheel contacts the right side of stem 322, then flexible boot 324 will allow the stem to pivot around left fulcrum 326, moving head 330 to the right. Head 330 will disengage from left valve seat 328. Fluid from plenum 22 will then travel through reverse nozzle vanes 344 and reverse propulsion vanes 346. This will decelerate the vehicle.

Figure 7:
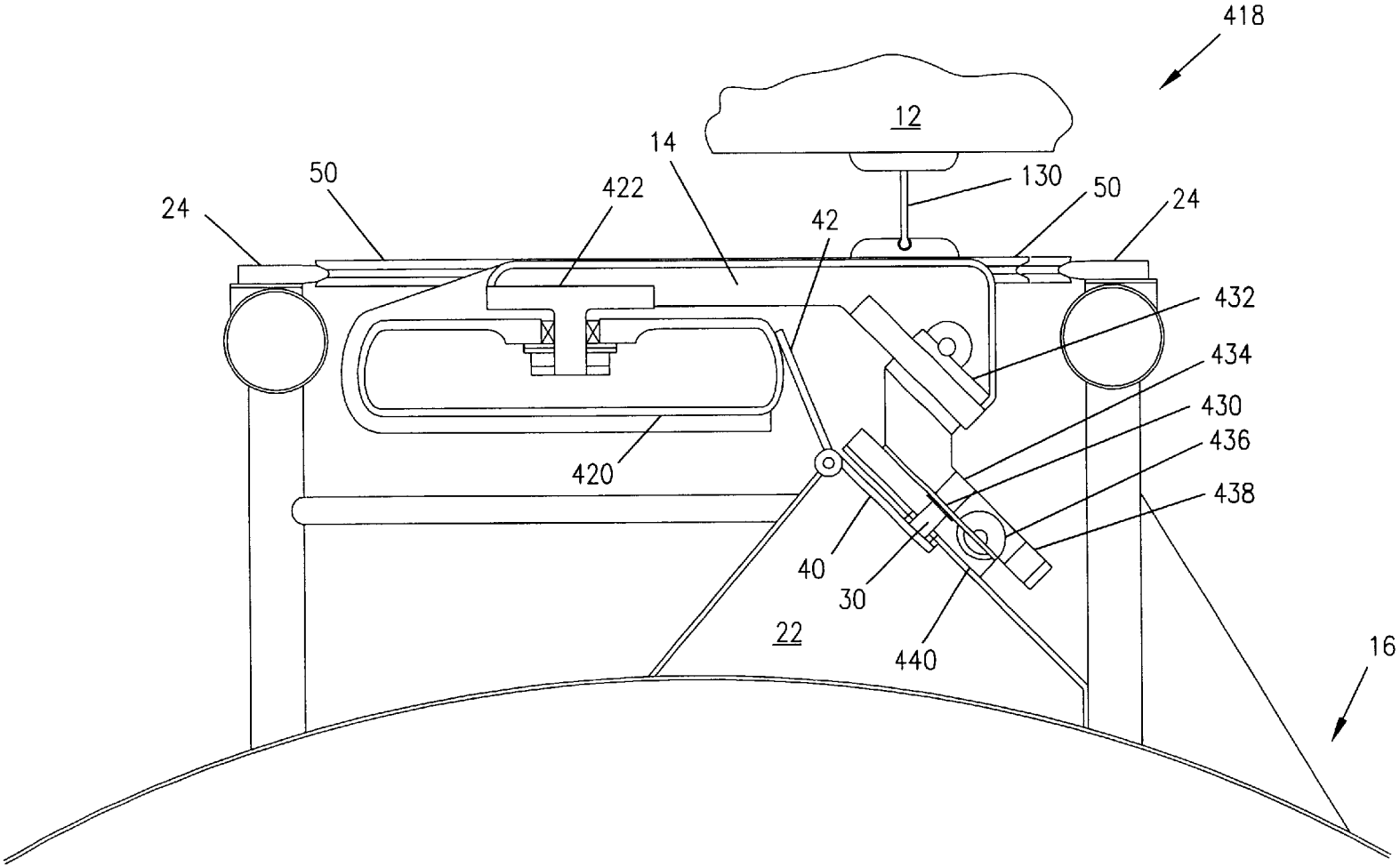
FIG. 7 is a front view of the fifth embodiment of the propulsion assembly.

A fifth embodiment of the propulsion assembly is shown in FIG. 7 and designated 418. Each power unit guide wheel 50 engages one guide wheel track 24, alternating sides as in FIG. 3. In this embodiment, there is a single row of forward facing nozzles 30, fed by a single row of strip valves 40. Strip valve 40 is opened when actuator 422 moves wheel 420 into contact with armature 42 and forces armature 42 to move. Fluid then travels from plenum 22 through valve 40 and through nozzles 30. If actuator 432 has positioned thrust reversing assembly 430 such that forward propulsion vanes 434 are lined up with nozzles 30, then the vehicle accelerates. If actuator 432 moves thrust reversing assembly 430 such that spiral transfer vanes 436 line up with nozzles 30, then the fluid travels through spiral transfer vanes 436, jet reversing vanes 440, and then thrust reversing vanes 438. This decelerates the vehicle. The more complicated thrust reversing assembly is needed here and not in FIGS. 4 and 5 because the nozzles face forward in this embodiment, where the nozzles in FIGS. 4 and 5 were perpendicular to the track direction.

Figure 8:
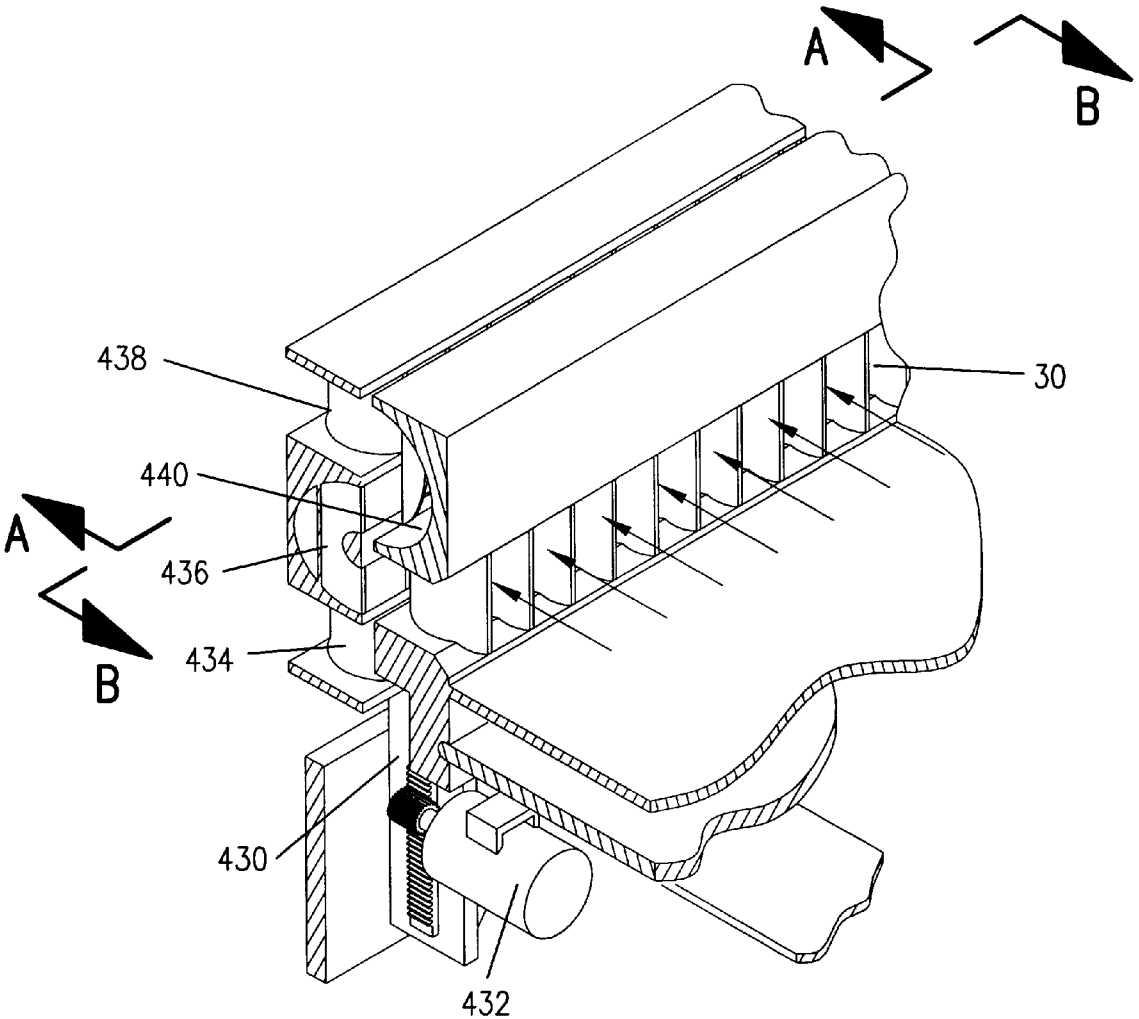
FIG. 8 is a front cutaway view of the thrust reversing assembly.
Figure 10:
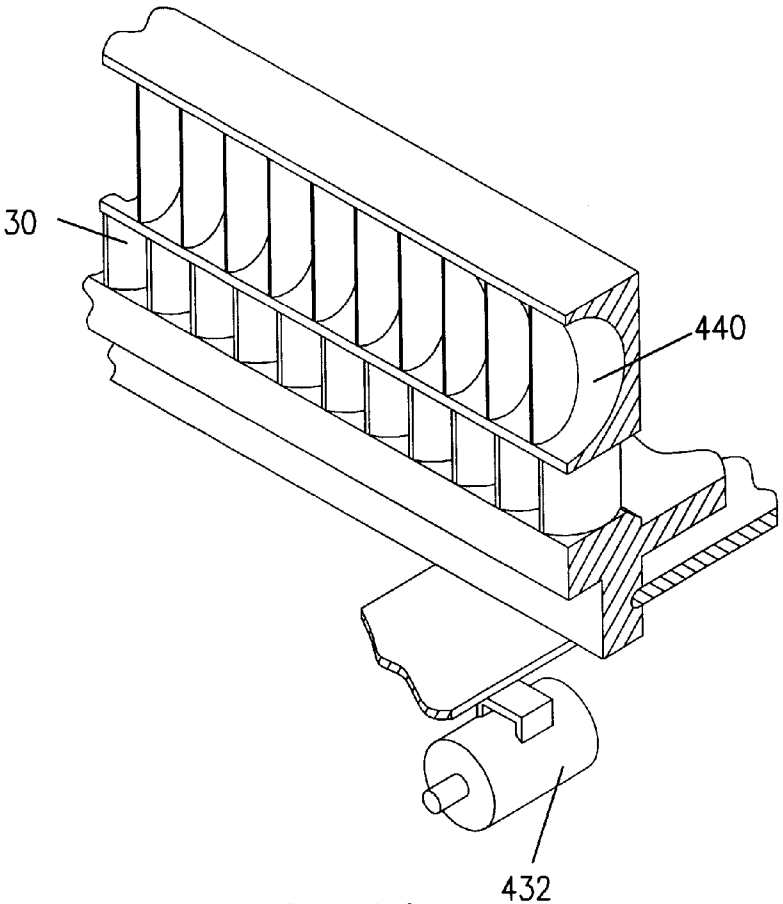
FIG. 10 is a side cutaway view of the thrust reversing assembly taken along line B—B of FIG. 8.
Figure 9:
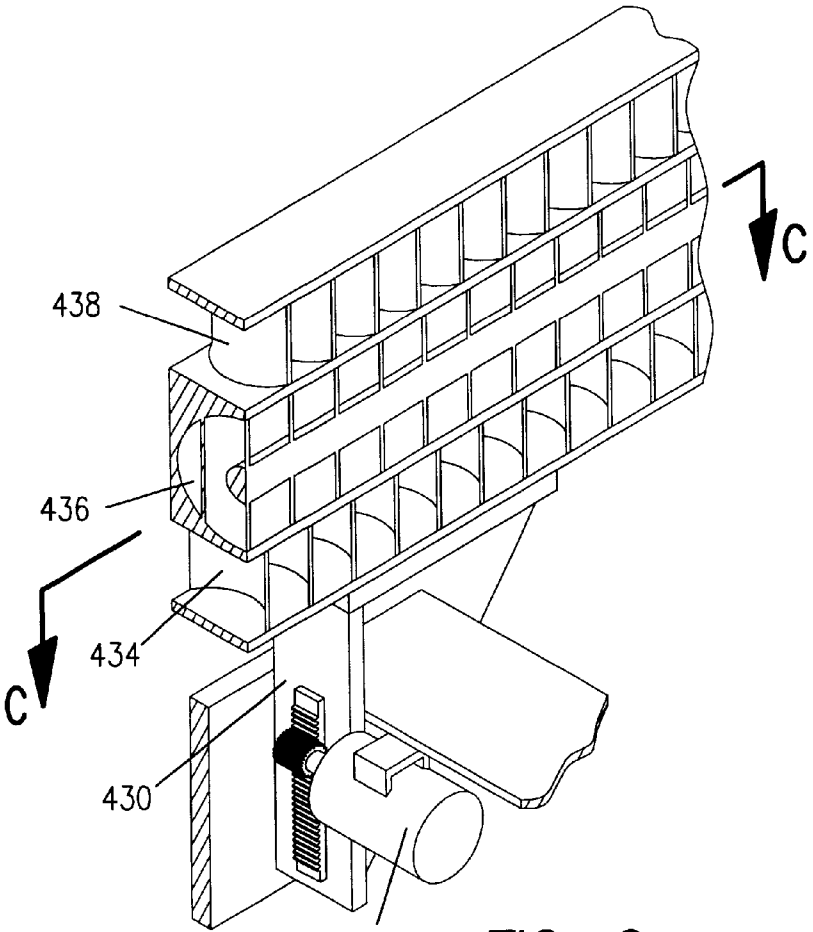
FIG. 9 is a side cutaway view of the thrust reversing assembly taken along line A—A of FIG. 8.

FIGS. 8–10 give side cutaway views of thrust reversing assembly 430. The front cutaway view of thrust reversing assembly 430 is shown in FIG. 8. Actuator 432 has positioned assembly 430 to decelerate the vehicle. Fluid travels through forward facing nozzles 30, spiral transfer vanes 436, jet reversing vanes 440, and thrust reversing vanes 438. To accelerate the vehicle, actuator 432 moves assembly 430 until forward propulsion vanes 434 line up with nozzles 30. Then the fluid will travel through nozzles 30 and forward propulsion vanes 434, providing forward thrust to the vehicle.

FIG. 9 shows the side cutaway view taken along line A—A of FIG. 8.

The structure of assembly 430 is visible, with forward propulsion vanes 434, spiral transfer vanes 436, and thrust reversing vanes 438 arrayed in rows down the length of assembly 430.

FIG. 10 shows the side cutaway view taken along line B—B of FIG. 8. Nozzles 30 and jet reversing vanes 440 are arrayed in rows down the length of the wall of plenum 22.

Figure 11:
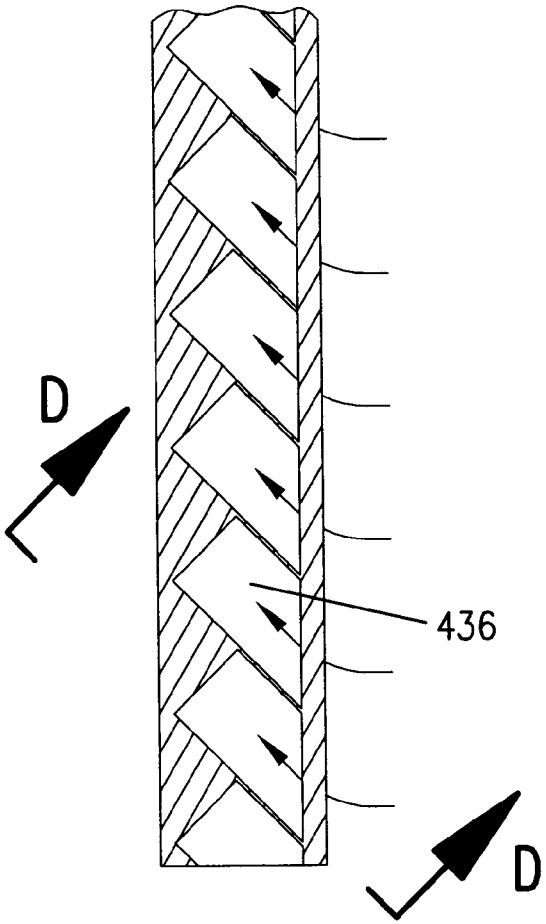
FIG. 11 is a top cutaway view of the spiral transfer vanes taken along line C—C of FIG. 9.

FIG. 11 shows the spiral transfer vanes 436 in a top cutaway view, taken at plane C—C of FIG. 9. The vanes are angled in the forward direction, as shown in this figure.

Figure 12:
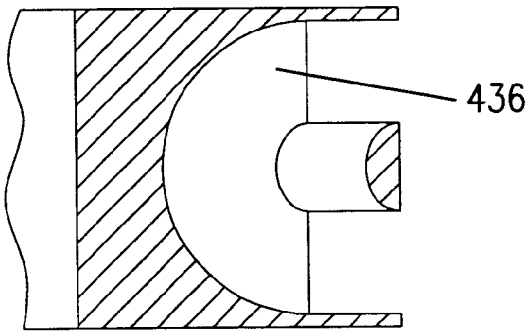
FIG. 12 is an angled side cutaway view of the spiral transfer vanes taken along line D—D FIG. 11.

FIG. 12 shows the spiral transfer vanes 436 in an angled side cutaway view, taken at plane D—D of FIG. 11. The angle of the view is equal to the angle between the vanes and the forward direction.

Thus, it is seen that the objects of the present invention are efficiently obtained, although modifications and changes to the invention should be readily apparent to those having ordinary skill in the art, and these modifications are intended to be within the spirit and scope of the invention as claimed. For example, strip valve armatures 40, 42, 45, and 322 may be moved by contact with a wheel, or moved by attraction by a permanent or electromagnet in any of the embodiments.

What is claimed is:

1. A propulsion/braking apparatus for a vehicle traveling along a guideway, said apparatus comprising:

a plurality of nozzles located along the length of said guideway, said plurality of nozzles being arranged to direct fluid jets generally in a travel direction of said guideway;

a plurality of strip valves arranged end-to-end along said guideway, each of said plurality of strip valves being operable to control flow from a group of nozzles in said plurality of nozzles;

a power unit mounted for travel along said guideway, said power unit having valve control means for opening said plurality of strip valves in succession to release fluid jets from said groups of nozzles controlled thereby, and a plurality of thrust vanes arranged to receive impulse energy from said released fluid jets to propel said power unit along said guideway in said travel direction, and means for connecting said vehicle to said power unit.

2. The apparatus recited in claim 1, wherein said fluid jet is an air jet.

3. The apparatus recited in claim 1, wherein said control means comprises at least one permanent magnet mounted on a bracket, said bracket movable by actuating means to move said at least one magnet proximate an armature of said strip valve, said permanent magnet operatively arranged to move said armature when said magnet proximate said armature, said armature operatively arranged to open said strip valve when said armature is moved.

4. The apparatus recited in claim 3, wherein said actuating means comprises an element from the group of elements comprising: an electric motor, a hydraulic piston, or a pneumatic piston.

5. The apparatus recited in claim 1, wherein said control means comprises at least one electromagnet located proximate an armature of said strip valve, said electromagnet operatively arranged to move said armature when said electromagnet is turned on, said armature operatively arranged to open said strip valve when said armature is moved.

6. The apparatus recited in claim 1, wherein control means comprises a wheel operatively arranged to move an armature of said strip valve when said wheel is actuated towards said armature, said armature operatively arranged to open said strip valve when said armature is moved.

7. A propulsion/braking apparatus for a vehicle traveling along a guideway, said apparatus comprising:

a first plurality of nozzles located along the length of said guideway, said first plurality of nozzles being arranged to direct fluid jets generally in a first direction along said guideway;

a second plurality of nozzles located along the length of said guideway, said second plurality of nozzles being arranged to direct fluid jets generally in a second direction along said guideway opposite said first direction;

a first plurality of strip valves arranged end-to-end along said guideway, each of said first plurality of strip valves being operable to control flow from a group of nozzles in said first plurality of nozzles;

a second plurality of strip valves arranged end-to-end along said guideway, each of said second plurality of strip valves being operable to control flow from a group of nozzles in said second plurality of nozzles;

a power unit mounted for travel along said guideway, said power unit having valve control means operable for selectively opening either said first plurality of strip valves in succession to release fluid jets directed generally in said first direction or said second plurality of strip valves in succession to release fluid jets directed generally in said second direction, a first plurality of thrust vanes arranged to receive impulse energy from released fluid jets directed generally in said first direction to apply force to said power unit along said first direction, and a second plurality of thrust vanes arranged to receive impulse energy from released fluid jets directed generally in said second direction to apply force to said power unit along said second direction; and means for connecting said vehicle to said power unit.

8. The apparatus recited in claim 7, wherein said fluid jet is an air jet.

9. The apparatus recited in claim 7, wherein said control means comprises at least one permanent magnet mounted on a bracket, said bracket movable by actuating means to move said at least one magnet proximate an armature of said strip valves, said permanent magnet operatively arranged to move said armature when said magnet proximate said armature, said armature operatively arranged to open said strip valves when said armature is moved.

10. The apparatus recited in claim 9, wherein said actuating means comprises an element from the group of elements comprising: an electric motor, a hydraulic piston, or a pneumatic piston.

11. The apparatus recited in claim 7, wherein said control means comprises at least one electromagnet located proximate an armature of each of said strip valves, said electromagnets operatively arranged to move said armature when said electromagnets are turned on, said armature operatively arranged to open said strip valves when said armature is moved.

12. The apparatus recited in claim 7, wherein control means comprises a wheel operatively arranged to move an armature of said strip valves when said wheel is actuated towards said armature, said armature operatively arranged to open said strip valves when said armature is moved.

13. The apparatus recited in claim 7, wherein said strip valves comprise a two way strip valve comprising:

a valve stem with a first end and a second end, said first end extending through and dividing a chamber into two portions, said second end connected to a valve head, said first chamber portion in flow communication with said first plurality of nozzles, and said second chamber in flow communication with said second plurality of nozzles;

a pair of fulcrums proximate to said stem and on opposite sides of said stem; and a pair of seals operatively arranged to seal said chamber when said valve head is engaged with said seals.

14. The apparatus recited in claim 13, wherein said control means comprises a pair of wheels operatively arranged to contact said first end of said valve stem, pivot said stem about one of said fulcrums, disengage said head from one of said seals, and allow fluid to flow from said plenum through one of said portions of said chamber behind said disengaged seal.

15. A propulsion/braking apparatus for a vehicle traveling along a guideway, said apparatus comprising:

a plurality of nozzles located along the length of said guideway, said plurality of nozzles being arranged to direct fluid jets generally in a transverse direction of said guideway;

a plurality of strip valves arranged end-to-end along said guideway, each of said plurality of strip valves being operable to control flow from a group of nozzles in said plurality of nozzles;

a first plurality of directional vanes for receiving and redirecting said fluid jets generally in a first direction along said guideway, and a second plurality of directional vanes for receiving and redirecting said fluid jets generally in a second direction along said guideway opposite said first direction;

a power unit mounted for travel along said guideway, said power unit having valve control means for opening said plurality of strip valves in succession to release fluid jets from said groups of nozzles controlled thereby, a directional manifold movable to a first position wherein said directional manifold acts to direct said released fluid jets to said first plurality of directional vanes and to a second position wherein said directional manifold acts to direct said released fluid jets to said second plurality of directional vanes, an actuator operatively connected to said directional manifold for selectively moving said directional manifold to either said first or second position, a first plurality of thrust vanes arranged to receive impulse energy from said released fluid jets directed thereto by said first plurality of directional vanes to apply force to said power unit along said first direction, and a second plurality of thrust vanes arranged to receive impulse energy from said released fluid jets directed thereto by said second plurality of directional vanes to apply force to said power unit along said second direction; and means for connecting said vehicle to said power unit.

16. The apparatus recited in claim 15, wherein said fluid jet is an air jet.

17. The apparatus recited in claim 15, wherein said control means comprises at least one permanent magnet mounted on a bracket, said bracket movable by actuating means to move said at least one magnet proximate an armature of said strip valve, said permanent magnet operatively arranged to move said armature when said magnet proximate said armature, said armature operatively arranged to open said strip valves when said armature is moved.

18. The apparatus recited in claim 17, wherein said actuating means comprises an element from the group of elements comprising: an electric motor, a hydraulic piston, or a pneumatic piston.

19. The apparatus recited in claim 15, wherein said control means comprises at least one electromagnet located proximate an armature of said strip valve, said electromagnet operatively arranged to move said armature when said electromagnet is turned on, said armature operatively arranged to open said strip valves when said armature is moved.

20. The apparatus recited in claim 15, wherein control means comprises a wheel operatively arranged to move an armature of said strip valve when said wheel is actuated towards said armature, said armature operatively arranged to open said strip valve when said armature is moved.

21. A propulsion/braking apparatus for a vehicle traveling along a guideway, said apparatus comprising:

a plurality of nozzles located along the length of said guideway, said plurality of nozzles being arranged to direct fluid jets generally in a first direction along said guideway;

a plurality of jet reversing vanes located along the length of said guideway proximate said plurality of nozzles for reversing the direction of said fluid jets from said first direction to a second direction generally opposite said first direction;

a plurality of strip valves arranged end-to-end along said guideway, each of said plurality of strip valves being operable to control flow from a group of nozzles in said plurality of nozzles;

a power unit mounted for travel along said guideway, said power unit having valve control means operable for selectively opening said plurality of strip valves in succession to release said fluid jets directed generally in said first direction, a first plurality of thrust vanes for receiving impulse energy from said fluid jets to apply force to said power unit along said first direction, a plurality of spiral transfer vanes for redirecting said fluid jets to said jet reversing vanes, a second plurality of thrust vanes for receiving impulse energy from said fluid jets directed generally in said second direction by said jet reversing vanes to apply force to said power unit along said second direction, and a thrust reversing actuator for selectively aligning either said first plurality of thrust vanes or said spiral transfer vanes with said plurality of nozzles to receive said fluid jets; and means for connecting said vehicle to said power unit.

22. The apparatus recited in claim 21, wherein said fluid jet is an air jet.

23. The apparatus recited in claim 21, wherein said control means comprises at least one permanent magnet mounted on a bracket, said bracket movable by actuating means to move said at least one magnet proximate an armature of said strip valve, said permanent magnet operatively arranged to move said armature when said magnet proximate said armature, said armature operatively arranged to open said strip valves when said armature is moved.

24. The apparatus recited in claim 23, wherein said actuating means comprises an element from the group of elements comprising: an electric motor, a hydraulic piston, or a pneumatic piston.

25. The apparatus recited in claim 21, wherein said control means comprises at least one electromagnet located proximate an armature of said strip valve, said electromagnet operatively arranged to move said armature when said electromagnet is turned on, said armature operatively arranged to open said strip valves when said armature is moved.

26. The apparatus recited in claim 21, wherein control means comprises a wheel operatively arranged to move an armature of said strip valve when said wheel is actuated towards said armature, said armature operatively arranged to open said strip valve when said armature is moved.

* * * * *